United States Patent [19]

Wixon

[11] Patent Number: 4,664,950

[45] **Date of Patent: * May 12, 1987**

[54] CONCENTRATED HEAVY DUTY PARTICULATE LAUNDRY DETERGENT

[75] Inventor: Harold E. Wixon, New Brunswick, N.J.

[73] Assignee: The Colgate Palmolive Co., New York, N.Y.

[ * ] Notice: The portion of the term of this patent subsequent to Oct. 25, 2000 has been disclaimed.

[21] Appl. No.: 475,294

[22] Filed: Mar. 14, 1983

Related U.S. Application Data

[60] Continuation of Ser. No. 183,022, Sep. 2, 1980, Pat. No. 4,411,809, which is a division of Ser. No. 746,900, Dec. 2, 1976, Pat. No. 4,248,911.

[51] Int. Cl.[4] ..... C11D 3/075; C11D 3/12; C11D 11/00; C11D 17/06

[52] U.S. Cl. ..... 427/214; 252/91; 252/140; 252/174.13; 252/174.21; 252/174.25; 252/383; 252/384; 427/215; 427/220

[58] Field of Search ..... 252/131, 140, 174, 174.21, 252/174.25, 179, 383, 385, 91; 427/214, 215, 220

[56] References Cited

U.S. PATENT DOCUMENTS

| | | | |
|---|---|---|---|
| 3,290,158 | 12/1966 | Treat | 252/385 |
| 3,755,180 | 8/1973 | Austin | 252/99 |
| 3,838,072 | 9/1974 | Smith | 252/540 |
| 3,868,336 | 2/1975 | Mazzola | 252/527 |
| 3,915,878 | 10/1975 | Yurko | 252/89 |
| 4,007,124 | 2/1977 | Collier | 252/109 |
| 4,136,051 | 1/1979 | Saran | 252/91 |
| 4,391,727 | 7/1983 | Benz | 252/99 |
| 4,397,777 | 8/1983 | Yurko | 252/536 |
| 4,414,130 | 11/1983 | Cheng | 252/140 |
| 4,427,567 | 1/1984 | Benz | 252/116 |

FOREIGN PATENT DOCUMENTS

| | | | |
|---|---|---|---|
| 849234 | 4/1977 | Belgium | 252/140 |
| 2535792 | 3/1976 | Fed. Rep. of Germany | 252/140 |
| 2538680 | 3/1976 | Fed. Rep. of Germany | 252/131 |
| 2736903 | 2/1978 | Fed. Rep. of Germany | 252/140 |

*Primary Examiner*—Dennis L. Albrecht
*Attorney, Agent, or Firm*—Kenyon & Kenyon

[57] ABSTRACT

A free flowing particulate heavy duty laundry detergent containing no more than 8.7% of phosphorus (from phosphate) is comprised of sodium tripolyphosphate particles having nonionic detergent in the interior and on the surface thereof, which adheres a coating of smaller particles of ion-exchanging zeolite to the phosphate. Also within the invention is a method of making such a product by pre-mixing spray dried sodium tripolyphosphate particles and smaller zeolite particles and admixing with them, as by spraying, in liquid form, onto moving particles, a normally liquid or pasty nonionic detergent, such as a higher fatty alcohol polyethylene oxide condensation product, which penetrates the sodium tripolyphosphate particles and adheres zeolite particles to the surfaces thereof.

10 Claims, No Drawings

CONCENTRATED HEAVY DUTY PARTICULATE LAUNDRY DETERGENT

This is a continuation of application Ser. No. 183,022 filed Sept. 2, 1980, now U.S. Pat. No. 4,411,809, which in turn is a division of application Ser. No. 746,900 filed Dec. 2, 1976, now U.S. Pat. No. 4,248,911.

This invention relates to improved free flowing, high bulk density, particulate, heavy duty laundry detergents. More particularly, it relates to such products comprising sodium tripolyphosphate particles, ion exchanging zeolite particles and a normally liquid or pasty nonionic detergent. Also within the invention are methods for the manufacture of such products Heavy duty powdered laundry detergents based on synthetic organic detergents and builder salts are well known and have been employed extensively as household and commercial detergents for washing soiled clothing and other such items. Sodium tripolyphosphate is among the best of such builder salts and nonionic detergents have been employed as supplemental or principal detergents in heavy duty laundry products. Phosphate contents of detergent compositions have been limited by law and regulations in view of evidence which has been interpreted to indicate that they contribute to eutrophication of inland waters when discharged into such waters either directly or indirectly and accordingly, substitute builders have been sought. Among the substitutes recently tried are the zeolites, particularly, the molecular sieve zeolites of types A, X and Y, all of which are sodium aluminosilicates (hydrated or anhydrous) and which are of high calcium ion exchanging capacities.

It is known that high bulk density detergents can be made but these very often are objectionably fine powders which can "smoke" or cause sneezing and eye irritation when they are poured out of a container during use. Attempts have been made to make free flowing and dust-free particulate detergent compositions of increased concentrations of active ingredients and increased bulk densities so that comparatively small quantities thereof could be employed and detergent boxes could be decreased in size but so far as is known, until the present invention none of such compositions met the various requirements of diminished but effective phosphate content, free flowability, excellent detergency and employment of non-toxic builders and were non-caking and capable of being readily made by simple, currently practiced methods.

In accordance with the present invention a free flowing, particulate, heavy duty laundry detergent of bulk density of at least 0.6 g./cc. and particle sizes in the range of 4 to 140 mesh comprises sodium tripolyphosphate particles, ion exchanging zeolite particles and normally liquid or pasty nonionic detergent, with the tripolyphosphate particles being of sizes in the 8 to 140 mesh range, U.S. Standard Sieve Series, the zeolite being of ultimate particle diameters in the range of 0.01 to 20 microns and the nonionic detergent being in the interior and at the surfaces of the tripolyphosphate particles and adhering the zeolite particles to the tripolyphosphate particles. Also within the invention is a method of making such products by pre-mixing the sodium tripolyphosphate particles and smaller zeolite particles and then admixing with such mixture a nonionic detergent in liquid form so as to cause the detergent to penetrate the sodium tripolyphosphate particles and adhere the zeolite to the surfaces of such particles. The products made are excellent concentrated particulate detergents of high bulk density, making it possible to utilize small volumes thereof, e.g., 50–125 cc., for an average wash in an automatic washing machine (which has a tub volume of about 65 liters and washes a charge of about 4 kg. of soiled garments, etc.). Thus, smaller packages may be employed for similar effective quantities of detergent compositions and shelf space may be conserved in the supermarket and in the home. Of course, it is also easier to handle the smaller packages and to pour from them, resulting in more convenience and less spillage.

The zeolites which may be employed in practicing the present invention include the crystalline, amorphous and mixed crystalline-amorphous zeolites of both natural and synthetic origins which are of satisfactorily quick and sufficiently effective activities in counteracting hardness ions, such as calcium ions, in wash waters. Preferably, such materials are capable of reacting sufficiently rapidly with hardness cations, such as calcium, magnesium, iron and the like or any one of them, to soften wash water before adverse reactions of such hardness ions with other components of the synthetic organic detergent composition occur. The zeolites employed may be characterized as having a high exchange capacity for calcium ion, which is normally from about 200 milligram equivalents of calcium carbonate hardness per gram of the aluminosilicate to 400 or more of such milligram equivalents, and a hardness depletion rate residual hardness of 0.02 to 0.05 mg. $CaCO_3$/liter in one minute, on an anhydrous zeolite basis. Preferably the exchange capacity will be between 250 and 350 mg. eq./g. and the residual hardness will be of 0.02 to 0.03 mg./l. and most preferably less than 0.01 mg./l.

Although other ion exchanging zeolites may also be utilized normally the finely divided synthetic zeolite builder particles employed in the practice of this invention will be of the formula $$(Na_2O)_x.(Al_2O_3)y.(SiO_2)_z.w\ H_2O$$

wherein x is 1, y is from 0.8 to 1.2, preferably about 1, z is from 1.5 to 3.5, preferably 2 to 3 or about 2 and w is from 0 to 9, preferably 2.5 to 6.

The water soluble crystalline aluminosilicates used are often characterized by having a network of substantially uniformly sized pores in the range of about 3 to 10 Angstroms, often being about 4 Å (normal), such size being uniquely determined by the unit structure of the zeolite crystal. Of course, zeolites containing two or more such networks of different pore sizes can also be satisfactorily employed, as can mixtures of such crystalline materials with each other and with amorphous materials, etc.

The zeolite should be a univalent cation-exchanging zeolite, i.e., it should be an aluminosilicate of a univalent cation such as sodium, potassium, lithium (when practicable) or other alkali metal, ammonium. Preferably the univalent cation of the zeolite molecular sieve is an alkali metal cation, especially sodium or potassium and most preferably, is sodium, but various other types are also useful.

Crystalline types of zeolites utilizable as molecular sieves in the invention, at least in part, include zeolites of the following crystal structure groups: A, X, Y, L, mordenite and erionite, of which types A, X and Y are preferred. Mixtures of such molecular sieve zeolites can also be useful, especially when type A zeolite is present. These crystalline types of zeolites are well known in the art and are more particularly described in the text *Zeolite Molecular Sieves* by Donald W. Breck, published in 1974 by John Wiley & Sons. Typical commercially available zeolites of the aforementioned structural types are listed in Table 9.6 at pages 747–749 of the Breck text, which table is incorporated herein by reference.

Preferably the zeolite used in the invention is synthetic and it is also preferable that it be of type A or similar structure, particularly described at page 133 of the aforementioned text. Good results have been obtained when a Type 4A molecular sieve zeolite is employed, wherein the univalent cation of the zeolite is sodium and the pore size of the zeolite is about 4 Angstroms. Such zeolite molecular sieves are described in U.S. Pat. No. 2,882,243, which refers to them as Zeolite A.

Molecular sieve zeolites can be prepared in a hydrated or water loaded form which contains additional bound water in an amount from about 10% up to about 36% of the zeolite total weight, depending on the type of zeolite used. The water-containing hydrated form of the molecular sieve zeolite (preferably about 15 to 70% hydrated) is preferred in the practice of this invention when such crystalline product is used. The manufacture of such crystals is well known in the art. For example, in the preparation of Zeolite A, referred to above, the hydrated zeolite crystals that are formed in the crystallization medium (such as a hydrous amorphous sodium aluminosilicate gel) are used without the high temperature dehydration (calcining to 3% or less water content) that is normally practiced in preparing such crystals for use as catalysts, e.g., cracking catalysts. The crystalline zeolite, in either completely hydrated or partially hydrated form, can be recovered by filtering off the crystals from the crystallization medium and drying them in air at ambient temperature so that their water contents are in the range of about 5 to 30% moisture, preferably about 10 to 25%, such as 17 to 22%.

The zeolites used as molecular sieves should usually also be substantially free of adsorbed gases, such as carbon dioxide, since such gas-containing zeolites can produce undesirable foaming when the zeolite-containing detergent is contacted with water; however, sometimes the foaming is tolerated and it may sometimes be desirable.

Preferably the zeolite should be in a finely divided state with the ultimate particle diameters being up to 20 microns, e.g., 0.005 or 0.01 to 20 microns, preferably being from 0.01 to 15 microns and especially preferably of 0.01 to 7 microns mean particle size, e.g., 3 to 7 or 12 microns, if crystalline, and 0.01 to 0.1 micron, e.g., 0.01 to 0.05 microns, if amorphous.

Although the crystalline synthetic zeolites are more common and better known, amorphous zeolites may be employed instead and are often superior to the crystalline materials in various important properties, as will be described, as may be mixed crystalline-amorphous materials and mixtures of the various types of zeolites described. The particle sizes and pore sizes of such materials may be like those previously described but variations from the indicated ranges may be made, as described, providing that the materials function satisfactorily as builders and do not objectionably overwhiten dyed materials with which they are treated in aqueous media.

Various suitable crystalline molecular sieve zeolites are described in U.S. patent applications of Bao-Ding Cheng, Ser. Nos. 467,688, filed May 7, 1974; 503,734, filed Sept. 6, 1974; and 640,793 and 640,794, filed Dec. 15, 1975, all now abandoned, all of which are hereby incorporated by reference for such descriptions and for descriptions therein of other materials within this invention. A preferred ion exchange zeolite is the amorphous zeolite of Belgian Pat. No. 835,351 of the formula $$M_2O.Al_2O_3.(SiO_2)_z.w\ H_2O$$

wherein z is from 2.0 to 3.8 and w is from 2.5 to 6, especially where M is sodium. Such patent and applications are also incorporated herein by reference to avoid the necessity for lengthy recitations of such materials, methods for their manufacture and uses, etc.

Sodium tripolyphosphate, also known as pentasodium tripolyphosphate ($Na_5P_3O_{10}$), will preferably be employed as a spray dried product resulting from the drying of a crutcher mix of aqueous pentasodium tripolyphosphate. Such spray dried beads are rounded and often are substantially globular, facilitating flow, and they often contain hollows and openings, helping to make them sorptive. Although other forms of the phosphate, made by other processes, may also be employed, with rounded, rather than angular particles being highly preferred for their contribution to free flow of the detergent composition, the spray dried products are much preferred. Such products may be obtained by spray drying an aqueous sodium tripolyphosphate suspension-solution (crutcher mix) or a crutcher mix which includes other heat stable components of the detergent composition too, some of which will be mentioned subsequently. Normally it is preferred that at least 60%, preferably 70% and most preferably, about 75% of the particles herein called sodium tripolyphosphate particles should be of the tripolyphosphate, with the balance normally being water (the tripolyphosphate is often partially hydrated), other builder salts, e.g., sodium silicate, and minor adjuvants, e.g., fluorescent brightener(s), stablizer(s), colorant(s).

The nonionic detergents include those described at length in McCutcheon's *Detergents and Emulsifiers,* 1973 Annual and in *Surface Active Agents,* Vol. II, by Schwartz, Perry and Berch (Interscience Publishers, 1958), the descriptions of which are hereby incorporated by reference. Such nonionic detergents are usually pasty or waxy solids at room temperature (20° C.) which are either sufficiently water soluble to dissolve promptly in water or will quickly melt at the temperature of the wash water, as when that temperature is above 40° C. The nonionic detergents employed will normally be those which are liquid or pasty at room temperature but preference will be given to normally pasty, semi-solid or solid products because such are less liable to make a tacky product of poor flow properties and susceptibility toward lumping or setting on storage. Also they are less liable to weep and release their "holds" on the zeolites. Still, the useful nonionic detergents will be liquefiable so that they may be sprayed at reasonable temperatures, such as those below 45°, 50° or 60° C. Typical useful nonionic detergents are the poly-(lower alkenoxy) derivatives that are usually prepared by the condensation of lower (2 to 4 carbon atoms) alkylene oxide, e.g., ethylene oxide, propylene oxide (with enough ethylene oxide to make a water soluble product) with a compound having a hydrophobic hydrocarbon chain and containing one or more active hydrogen atoms, such as higher alkyl phenols, higher fatty acids, higher fatty mercaptans, higher fatty amines and higher fatty polyols and alcohols, e.g., fatty alcohols having 8 to 20 or 10 to 18 carbon atoms in an alkyl chain and alkoxylated with an average of about 3 to 30, preferably 3 to 15 or 6 to 12 lower alkylene oxide units. Preferred nonionic surfactants are those represented by the formula $RO(C_2H_4O)_nH$, wherein R is the residue of a linear saturated primary alcohol (an alkyl) of 10 or 12 to 18 carbon atoms and n is an integer from 3 or 6 to 15. Typical commercial nonionic surface active agents suitable for use in the invention include Neodol® 45-11, which is an ethoxylation product (having an average of about 11 ethylene oxide units) of a 14 to 15 carbon atom (average) chain fatty alcohol (made by Shell Chemical Company); Neodol 25-7, a 12 to 15 carbon atom chain fatty alcohol ethoxylated with an average of 7 ethylene oxide units; and Alfonic® 1618-65, which is a 16 to 18 carbon alkanol ethoxylated with an average of 10 to 11 ethylene oxide units (Continental Oil Company). Also useful are the Igepals® of GAF Co., Inc. Such materials are usually the polyethoxylated (3 to 30 ethylene oxide units) middle alkyl (6 to 10 carbon atoms) phenols, such as Igepals CA-630, CA-730 and CO-630. The Pluronics® (made by BASF-Wyandotte), such as Pluronic F-68 and F-127, which are condensates of ethylene oxide with hydrophobic bases formed by condensing propylene oxide with propylene glycol, usually having molecular weights in the range of 5,000 to 25,000, may also be employed, as may be the various Tweens® (Atlas Chemical Industries), which are polyoxyethylene sorbitan higher fatty acid (12 to 18 carbon atoms) esters, such as those containing 20 to 85 mols of ethylene oxide per mol. Various other nonionic detergents described in the texts previously incorporated by reference may also be employed but preferably the proportion of nonionic detergent or surface active agent present, when other than the higher fatty alcohol polyoxyethylene ethanols, will be a minor one, rarely being more than 50% and preferably no more than 25% of the total nonionic detergent content. In the above description higher, as in higher alkyl, higher fatty, etc., means from 8 to 20, preferably from 10 or 12 to 18.

In addition to the sodium tripolyphosphate builder salt various other builders may also be present, such as alkali metal carbonates, bicarbonates, borates, silicates and other phosphates but with the exception of the silicates, which are especially useful as anti-corrosion additives, in addition to having sequestering powers (especially for magnesium ions) it is generally preferred to omit other builders although in some cases carbonates may also be desired components. In any case, the sum of such builders will be a minor one in the composition and in the spray dried phosphate beads, in which they will usually be present. Normally the content of such builder salts will total no more than 25% of the total of such builder salt plus tripolyphosphate in the product. Preferably, when, of the builders, only sodium silicate is present, the proportion thereof will be 4 to 10% in the final product, e.g., 6%, and 10 to 30% in the tripolyphosphate granules, more preferably 10 to 20%. The silicate should be of $Na_2O:SiO_2$ ratio in the range of 1:1.6 to 1:3.0, preferably 1:2.0 to 1:2.7 and most preferably about 1:2.4.

Although nonionic synthetic organic detergents are important components of the present products they may be partially replaced or supplemented by anionic organic detergents and in some cases by amphoteric organic detergents, too. However, the nonionic content will be the major proportion of the detergent present and normally the proportion of anionic detergent and/or amphoteric detergent in the final product will be less than 10%. Most preferably, only nonionic detergent is employed. Normally the anionic detergents will be sufficiently heat stable to be capable of being spray dried with the polyphosphate but they may also be suitably combined with the nonionic detergent being sprayed onto the surfaces of the mixture of zeolite and phosphate or may sometimes be mixed with the polyphosphate and zeolite before addition of the nonionic.

Among the anionic detergents that are useful are the sulfates, sulfonates and phosphonates of lipophilic moieties, especially those containing higher carbon atom chains, such as those of 8 to 20 or 10 to 18 carbon atoms.

Included among such compounds are the linear higher alkylbenzene sulfonates, olefin sulfonates, paraffin sulfonates, fatty acid soaps, higher fatty alcohol sulfates, higher fatty acid monoglyceride sulfates, sulfated condensation products of ethylene oxide (3 to 30 mols per mol) and higher fatty alcohol, higher fatty acid esters of isethionic acid and other known anionic detergents, such as also are mentioned in the texts previously incorporated herein by reference. Most of these products are normally in solid form, usually as the alkali metal, e.g., sodium, salts and may be spray dried with the phosphate. Agglomeration techniques, spray cooling, pilling and other methods may be employed for making equivalent tripolyphosphate particles, in addition to spray drying, with or without the presence of anionic detergent. A few examples of suitable anionic detergents include sodium linear tridecyl benzene sulfonate, sodium cocomonoglyceride sulfate, sodium lauryl sulfate and sodium paraffin and olefin sulfonates, each of an average of about 16 carbon atoms.

While amphoteric compounds such as the sodium salt of Miranol® $C_2M$ and Deriphat® 151 may be employed in the present detergents in replacement of all or part, e.g., up to 50%, of the anionic detergent, usually no amphoteric detergent will be present. Like the anionic detergents, the amphoterics may be spray dried or otherwise co-formed with the tripolyphosphate or may be dispersed in the liquid nonionic detergent or mixed with other powders during the making of the present products.

Various adjuvants, both functional and aesthetic, may be included in the present compositions, such as bleaches, e.g., sodium perborate; colorants, e.g., pigments, dyes; fluorescent brighteners, e.g., stilbene brighteners; foam stabilizers, e.g., alkanolamides, such as lauric myristic diethanolamide; enzymes, e.g., proteases; skin protecting and conditioning agents, such as water soluble proteins of low molecular weight, obtained by hydrolysis of proteinaceous materials, such as animal hair, hides, gelatin, collagen; foam destroyers, e.g., silicones; bactericides, e.g., hexachlorophene; and perfumes. Usually such adjuvants and others, such as the silicates, will accompany the tripolyphosphate if they are stable to heat drying and will be dispersed in the nonionic detergent or mixed with the mixture of phosphate beads and zeolite powder, as may be most suitable, depending on the condition of the adjuvant, the physical state thereof and its other properties. Usually it will be preferred to have it spray dried with the polyphosphate so as to avoid possible interference with the sorption of the nonionic and coating of the phosphate with zeolite. Often by such incorporation with the phosphate the sorbing power of the phosphate may be increased.

Various other useful detergents and adjuvants are described in U.S. patent application Ser. No. 715,124 for Readily Disintegrable Agglomerates of Insoluble Detergent Builders and Detergent Compositions Containing Them, filed Aug. 17, 1976, by Bao-Ding Cheng, hereby incorporated by reference.

The proportions of tripolyphosphate particles, zeolite and nonionic detergent in the product should be chosen to obtain the desired free-flowing product of satisfactory high bulk density, when made by the method of this invention. Such proportions are 30 to 50% of tripolyphosphate particles, 30 to 50% of zeolite and 5 to 30% of nonionic detergent, with preferred ranges being 35 to 45%, 35 to 45% and 10 to 30%, respectively. The bulk density of the product will be at least 0.6 g./cc., preferably being 0.75 to 0.95 g./cc. and most preferably being about 0.8 to 0.9 g./cc. The particle sizes of the product will be in the 4 to 140 mesh range, preferably being 6 or 8 to 100 mesh. The particle sizes of the tripolyphosphate particles will be in the range of 8 to 140 mesh, preferably being 8 to 100 mesh and the zeolite powder, although much smaller in ultimate particle size, will usually be in the range of 100 to 400 mesh, preferably being 140 to 325 mesh. The tripolyphosphate powder charged to the crutcher may be of any suitable particle size and the crutcher mix will normally have a moisture content of 30 to 80%, preferably 40 to 70%. Spray drying may be in normal spray drying towers, such as countercurrent towers with the spray pressure and nozzle size being adjusted to produce the desired bead structure (spherical), size and moisture content, which will usually be from 2 to 20% therein. The bulk density of the polyphosphate beads employed will usually be in the range of 0.4 to 0.8 g./cc. and that of the zeolite powder utilized will be in the same general range. The tripolyphosphate particles will normally contain at least 60% of sodium tripolyphosphate, preferably at least 70% thereof and more preferably from 70 to 85% thereof, when there are present other adjuvants, such as 10 to 20% of sodium silicate and from 0.1 to 5% of fluorescent brightener, with 5 to 15% of water, too.

The free flowing, particulate, high bulk density, heavy duty laundry detergents of this invention are easily made by mixing together the described sodium tripolyphosphate particles and zeolite particles and then admixing with such mixture a nonionic detergent in liquid form. The detergent penetrates the sodium tripolyphosphate particles and adheres the zeolite to the surfaces thereof. Usually the tripolyphosphate particles are spray dried particles containing at least 60% of sodium tripolyphosphate before addition of the nonionic detergent thereto. In such case the nonionic detergent is normally liquid or pasty, preferably pasty or semi-solid, and is sprayed as a liquid onto moving surfaces of the mixture of tripolyphosphate particles and zeolite, such liquid usually being at a temperature over 25° C. and preferably at least 40° C. The proportions of materials utilized are such that the product made will be of a desired, previously described composition.

The initial mixing of sodium tripolyphosphate particles and zeolite is normally effected at room temperature (20° to 25° C.) but the temperature may vary over the range of 10° to 40° C. Such mixing may take as little as 30 seconds or may be effected over a period as long as ten minutes but normally it is preferred to utilize a shorter time, e.g., 1–2 minutes. The higher fatty alcohol-polyethylene oxide condensation product is heated to an elevated temperature at which it is liquid and is sprayed onto the moving surfaces of the mixture of tripolyphosphate particles and zeolite. Preferably, the mixing and the spraying of the nonionic detergent onto the moving particles are effected in a rotating tube or drum inclined at a slight angle, e.g., 5° to 15°. Rotational speed may be any that is suitable, e.g., 10 to 50 r.p.m. Such spraying is usually effected over a period of about 1 to 5 minutes and mixing may be continued afterward for a period of 0 to 10 minutes, preferably 1 to 5 minutes. The spraying of the nonionic detergent will normally be such as to produce droplets of particle sizes in the 40 to 100 micron diameter range but other suitable spray sizes may be employed and in some cases the nonionic may be blended with the mixed powders after being dropped or poured onto the moving surfaces thereof. In such cases it is usually desirable to utilize a higher speed and higher energy mixer, such as one of the Lodige, twin shell or similar type to aid in breaking up any lumps caused by the addition of the larger droplets or streams of nonionic detergent. As was previously mentioned, although it is not preferred, sorptive tripolyphosphate made by methods other than spray drying may also be utilized but it is highly desirable for particles thereof to be rounded rather than angular.

After completion of mixing, sorption of the nonionic and holding of the zeolite powder to the surfaces of the tripolyphosphate beads, the product, which may have a moisture content of 2 to 20%, preferably 4 to 10%, is ready for packaging. Of course, as was previously mentioned, various adjuvants can be incorporated in the product by inclusion with suitable components or may be added thereto in suitable processing steps. The total adjuvant content, excluding water, will rarely exceed 20% of the product other than the mentioned tripolyphosphate, zeolite and nonionic detergent and will normally be less than 10% of the product. Of course, if a perborate bleach is utilized the percentage may be increased to an effective bleaching amount, which can be as high as 30% of the product. The perborate may be co-mixed with the zeolite and the tripolyphosphate or may be post-added to such pre-mix or to the nonionic-treated mixture. Colorants, perfumes and other adjuvants may be admixed with the various components and mixtures during manufacture or after completion thereof.

The products of this invention have significant advantages over other low phosphate (8.7% phosphorus and under) heavy duty detergents. They wash well, due to the presence of the tripolyphosphate and the zeolite builders with the comparatively large amount of nonionic detergent. They flow freely and don't cake because the coating of zeolite on the surface of the tripolyphosphate particles prevents any nonionic on the surface thereof from causing tackiness, poor flow properties and caking. The nonionic detergent on the surfaces of the tripolyphosphate particles constitutes only a small part, e.g., 10%, of the nonionic detergent in the product because the porous tripolyphosphate particles allow penetration of the nonionic to the interiors thereof and thereby insulate it from contact with the surfaces of other particles. Also, the rounded particles resulting help minimize contact areas and possible agglomeration. When amorphous zeolites are employed there is an improvement in non-deposition properties compared to when crystalline zeolites are utilized. Because of the presence of the nonionic detergent adjacent to the zeolite particles suspension thereof is promoted and deposition on or entrapment in the laundry is minimized. The products made are stable, non-caking under normal storage, resistant to bleeding of the nonionic, non-dusting, non-settling, free flowing, attractive and effective. Furthermore, because of their high bulk densities they are more convenient to pack, store and use. Additionally, they are readily made by a process which is energy conserving because only a fraction of the product is spray dried. Still further, because the nonionic is post-added little air pollution is caused by the manufacturing method, compared to that resulting when products containing substantial proportions of nonionic detergent are spray dried.

Although the products and methods previously described in the specification are preferred it has been found that it is sometimes desirable to further coat the particles with additional nonionic detergent and zeolite. Such additional coating is especially useful when it is desired that the final product have a higher content of nonionic detergent than can be absorbed by the nucleus builder particles and satisfactorily covered by the single layer of zeolite powder. Also, the recoating is useful to increase the particle sizes of the detergents and to improve further their roundness, preferably making them almost exactly spherical and thus improving their flowability. Normally the same types of nonionic detergent and zeolite employed in the making of the initial free flowing particles are utilized but others may also be employed. Instead of a single recoating operation a plurality of these operations may be effected but normally no more than two recoatings will be undertaken although as many as five are feasible. Of course, the desirability of obtaining the improvements in the recoated products must be weighed against the costs of the additional operations required, in determining whether such recoatings are commercially feasible. Therefore, normally no more than two recoatings, preferably only one, will be utilized.

In a similar vein, although it is highly preferred to follow the procedure previously described in the making of the free flowing detergent particles, wherein the tripolyphosphate and zeolite are first mixed and then the nonionic detergent is admixed therewith, it is also possible to coat the base particles of tripolyphosphate or other base builder salt or mixture thereof with nonionic detergent and then adhere the zeolite to the surface thereof. The product so made may also be recoated, as described. Generally the proportions of nonionic detergent and zeolite employed in each recoating will be within the proportions of the ranges of percentages of these materials in the original detergent composition, the final product will be within the percentage ranges of components given and the sum of the percentages of nonionic detergent and zeolite particles utilized in recoating will be less than halves of the percentages of such materials present in the product to be recoated and preferably will be less than 30% thereof. The recoating operations may be conducted in the same tumbling drums as previously described and under the same mixing conditions previously mentioned for the applications of the nonionic and zeolite.

The following examples illustrate various embodiments of the invention but it is not to be considered as being limited to them. Unless otherwise mentioned all parts are by weight and all temperatures are in °C.

EXAMPLE 1

| | Percent |
|---|---|
| Neodol 25-7 (nonionic detergent condensation product of $C_{12-15}$ higher fatty alcohol with an average of 7 mols ethylene oxide, mfd. by Shell Chemical Company) | 20 |
| Type 4A high ion exchange capacity crystalline zeolite (Zeolite CH—252-91-1, 170 to 270 mesh, mfd. by J. M. Huber Corp.) | 40 |
| Sodium tripolyphosphate granules [75% pentasodium tripolyphosphate, 14% sodium silicate ($Na_2O:SiO_2$ = 1:2.4), 0.5% of Tinopal 5BM fluorescent stilbene brightener, 0.006% bluing (blue dye blend) and 10.5% of water] | 40 |

The pentasodium tripolyphosphate granules are made by spray drying an aqueous slurry of the described materials with a moisture content of 40% in a countercurrent spray drying tower to produce beads of the formula given, having particle sizes in the 8 to 140 mesh, U.S. Standard Sieve Series, range. The spray dried particles, at a temperature of about 25° C., are mixed over a period of one minute in a twin-shell blender with the formula amount of the zeolite powder, which is of a particle size in the 170 to 270 mesh range. After such mixing the intermediate product is transferred to an inclined rotating drum, into which there is sprayed the nonionic detergent at a temperature of 45° C., at which temperature it is in liquid form. The droplets sprayed are of particle sizes largely in the range of 40 to 100 microns in diameter and they are impinged onto the moving surfaces of the mixture of zeolite and tripolyphosphate as the drum rotates at 40 r.p.m. After three minutes all the nonionic detergent has been sprayed onto the product and after another three minutes it has been sufficiently sorbed and has adhered the smaller zeolite particles to the surfaces of the tripolyphosphate particles. Some of the zeolite particles also penetrate into some of the pores of the tripolyphosphate particles, as does some of the nonionic detergent, with approximately 5 to 20%, e.g., 10% of the nonionic remaining at the surfaces of the particles. A small proportion of the zeolite powder becomes agglomerated during spraying and mixing because of the comparatively large proportion thereof in the present formula but the particle sizes of the agglomerates approximate those of the other particles and do not contribute to tackiness.

The particulate laundry detergent made is of a bulk density of about 0.8 g./cc., at least twice that normally obtained for commercial heavy duty laundry detergent compositions Because or at least partially because of its greater bulk density it is more convenient to use and store, is stable on storage, is of excellent flow properties, is non-tacky and non-caking and does not dust objectionably when poured. The phosphorus content thereof is under 8.7% and therefore the product is in accordance with government regulations in many areas.

In a comparative experiment, when instead of the described spray dried sodium tripolyphosphate beads there is utilized a granular, commercial pentasodium tripolyphosphate having particle sizes in the range of 120 to 200 mesh, the product resulting is not as free flowing and is not otherwise as effective as the preferred product previously described although it may be considered as being acceptable for many applications. Similarly, when a corresponding tetrasodium pyrophosphate is employed a less desirable product results although it is of utility as a detergent.

When the mixture of sodium tripolyphosphate, sodium silicate, fluorescent brightener, bluing and water is replaced by spray dried sodium tripolyphosphate (2% moisture content) of particle sizes in the 8 to 140 mesh range and the other treatments of this example are repeated the resulting product is also an excellent free flowing detergent but the beads are more friable, although acceptable, and without the presence of the silicate detergent they are also somewhat more corrosive to aluminum parts. However, the product is a useful, non-tacky, free flowing detergent of a high bulk density of about 0.7 to 0.8 g./cc.

EXAMPLE 2

| | Percent |
|---|---|
| Neodol 25-7 | 20 |
| Spray dried pentasodium tripolyphosphate (2% moisture content, 8 to 140 mesh) | 35 |
| Britesil ® hydrous silicate particles (18% $H_2O$, $Na_2O:SiO_2$ ratio of 1:2, mfd. by Philadelphia Quartz Company) | 10 |
| Type 4A zeolite (Zeolite CH—252-91-1) | 35 |

The spray dried pentasodium tripolyphosphate beads, the silicate particles (of particle sizes in the 100 to 200 mesh range) and the zeolite powder are mixed together and the nonionic detergent is admixed with them according to the primary method of Example 1. The product resulting is a good heavy duty detergent which is free flowing and of high bulk density (0.7 to 0.8 g./cc.). However, because of the presence of the hydrous sodium silicate of smaller particle size in the spray dried tripolyphosphate particles the flowability is not as good as that of the comparable product of Example 1. Similar results are obtained when instead of the spray dried pentasodium tripolyphosphate there are employed tetrasodium pyrophosphate particles of similar particle size. Also, when 4% of Neodol 25-3S is added to the formula and a corresponding 4% of zeolite is subtracted from it, with the Neodol 25-3S (sodium polyethoxy higher fatty alcohol sulfate [$C_{12-15}$ alcohol and 3 mols of ethylene oxide per mol], 60% active ingredient, 25% $H_2O$ and 15% $C_2H_5OH$, mfd. by Shell Chemical Company) being heated and mixed with the Neodol 25-7 and sprayed onto the tumbling beads, a good free flowing high bulk density product results.

EXAMPLE 3

When, in the examples previously given, the phosphate (or other suitable water soluble builder salt) and all other water soluble builder salts present are coated, internally and externally, with the Neodol 25-7 nonionic detergent and the resulting particles, resembling wet sand particles, in that they do not cohere strongly, and have a waxy, greasy appearance, are coated with the zeolite, with mixing times for the various mixings and coatings being about five minutes each, satisfactory high density flowable detergent products result. However, the two coating operations usually take more time and are somewhat more difficult to control than the previously described method. The products made are of desirable bulk densities, usually being about 0.8 g./cc.

EXAMPLE 4

This example describes a further modification and improvement in the products and methods of this invention, wherein additional quantities of nonionic detergent are incorporated in the product by utilization of sequential coating or recoating techniques. In Examples 1–3 the liquid nonionic detergent is applied in sufficient quantity so that it penetrates into the interiors of the nucleus or base particles, with such an excess present that it wets the surfaces of the particles so as to cause the zeolite powder to adhere to such surfaces. In some cases, when it is desired to employ more nonionic detergent in the product, making a more concentrated detergent composition, and the procedures of Examples 1–3 are followed, the excess liquid causes or promotes the production of an agglomerate or paste and a satisfactorily free flowing product is not obtainable. However, by the method of this example such undesirable result is avoided and additional nonionic detergent is satisfactorily incorporated in the product, which is still free flowing and of high bulk density. Furthermore, by this method the particle size may be increased desirably. Also, the additional coatings help to protect the components of the product (base beads, other builders and detergents, fluorescent brighteners, enzymes, and other adjuvants, from the air and moisture in it.

The procedures of Examples 1–3 are followed but in each case, based on 100 parts of product resulting from the practice of the methods of those examples, an additional five parts of the nonionic detergent are sprayed onto the product and an additional ten parts of zeolite are then mixed in with the product to be adhered to the nonionic coating thereon (using the spraying and mixing procedures described in Examples 1–3). The particle size increases about 5% (diameter) but the product is still of about the same bulk density as was previously obtained and still is free flowing and non-lumping. In further experiments, an additional five parts of the nonionic detergent are sprayed onto the two-stage product and an additional ten parts of the zeolite are dusted onto this, with similar desirable results (using the same spraying and mixing methods).

In the practice of the sequential enrichment and coating operations described the tripolyphosphate or other base particle will usually not be re-applied but this may be done when advantageous. Normally as many as six coating operations may be employed but it is preferred that this be limited to three such operations, as in the "further experiment" described herein. Also it is preferred that the totals of nonionic detergent and zeolite in coating operations subsequent to the first operation should be limited to the amounts employed in the first operation and preferably to halves of such amounts, with proportions of the nonionic and zeolite being within the proportions of the previously mentioned percentage ranges.

EXAMPLE 5

The procedures of Examples 1–4 are repeated with the tripolyphosphate being replaced by tetrasodium pyrophosphate and by an equal mixture of the pyrophosphate and the tripolyphosphate, types X and Y crystalline zeolites of similar particle sizes and amorphous zeolites being substituted for the type 4A zeolite and Neodols 23-6.5 and 45-11 and Alfonics 1618-65 and 1412-60 being substituted for the Neodol 25-7, and comparable high bulk density, free flowing detergent compositions are made. The only changes in manufacturing techniques are in maintaining the temperature of the nonionic detergent sufficiently high to ensure that it is in the liquid state when it is sprayed onto the surfaces of the base particles. Additionally, proportions of the various components are modified ±10% and ±30%, while being kept within the ranges of percentages and proportions previously mentioned. Care is taken that the proportion of nonionic detergent employed is such as to provide an unabsorbed portion on the surface of the base beads in the form of an adhering coating so as to hold the zeolite particles. When the nonionic detergent is normally solid the temperature of the detergent at the time of application of the zeolite or of the zeolite-builder salt mixture is maintained high enough so that the zeolite particles will adhere to it and the base particles.

The especially desirable results obtained in the above examples and in following the procedures of this invention to make the compositions thereof are unexpected. Although mixed nonionic, phosphate and zeolite had been previously employed in detergent compositions, so far as is known there has been no suggestion in the art to make a high bulk density product which is so free flowing and non-tacky and which can be made in a single step by applying nonionic to a phosphate-zeolite mixture. In the present cases, although 0.6 g./cc. is considered to be a high bulk density (tamped) for detergent products, usually the products made in accord with this invention will have even higher densities, normally being about 0.7 g./cc. or higher. The presence of the zeolite particles and their being held to the base particles to make the present type of product is not described in the prior art nor is the concept of utilizing sufficient liquid nonionic detergent to maintain a coating thereof on the base particles, despite the high sorption of liquid by such particles. By this method one makes a non-segregating, free-flowing product of desirable comparatively large particle size containing even more nonionic detergent than the base particles can normally hold. During the application of the nonionic detergent to the nucleus particles, which absorb much of the nonionic, the "excess" nonionic forms a coating on the surfaces of the particles which is of a greasy or waxy appearance and the particles do not agglomerate objectionably but do hold the smaller particles subsequently or simultaneously applied. When the zeolite application is subsequent, the mix, before the addition of zeolite, is not pasty; rather, it resembles moist sand, with each particle unattached to other such particles or releasably attached. The final products made are free flowing despite the sometimes presence of angular component particles in the base materials, partly because the coating of more finely divided zeolite helps to round them or make them spherical.

The invention has been described with respect to working examples and illustrations thereof but is not to be limited to these because it is evident that one of skill in the art with access to the present specification will be able to employ substitutes and equivalents without departing from the spirit or scope of the invention.

What is claimed is:

1. A free-flowing, particulate, heavy duty laundry detergent of bulk density of at least 0.6 g/cc. and particle sizes in the range of 4 to 140 mesh which comprises about 30–50% of substantially globular sodium tripolyphosphate particles, about 30–50% of zeolite particles and about 5–30% nonionic detergent, with the tripolyphosphate particles being of sizes in the 8 to 140 mesh range, U.S. Standard Sieve Series and containing about 5–15% water and about 10–20% of sodium silicate having an $Na_2O:SiO_2$ ratio in the range of about 1:1.6 to about 3.0, the zeolite being of ultimate particle diameters in the range of about 0.01 to 20 microns and wherein said zeolite is a crystalline, amorphous or mixed crystalline and amorphous zeolite, the exchange rate and capacity of said zeolite particles being such that when about 375 ppm of said zeolite on an anhydrous basis placed in water at about 45° C. containing about 40 ppm of dissolved calcium ion while vigorously stirring the dissolved calcium ion content of the water is reduced to below about 8 ppm in about 5 minutes; said nonionic detergent being in the interior and coating the surfaces of the tripolyphosphate particles, said nonionic detergent adhering the zeolite particles to the tripolyphosphate particles, and said nonionic detergent being a higher fatty alcohol polyethylene oxide condensate wherein the higher fatty alcohol is of about 10 to 18 carbons and the polyethylene oxide is of about 3 to 15 moles of ethylene oxide per mole of higher fatty alcohol.

2. A particulate heavy duty laundry detergent according to claim 1 wherein the sodium tripolyphosphate particles, exclusive of nonionic detergent therein, contain at least 60% of sodium tripolyphosphate, and the zeolite is selected from the group consisting of zeolites of types A, X and Y.

3. A particulate heavy duty detergent according to claim 2 wherein the sodium tripolyphosphate particles are of rounded particle form and, exclusive of the nonionic detergent, include at least 70% of sodium tripolyphosphate, 10 to 20% of sodium silicate of $Na_2O:SiO_2$ ratio in the range of about 1:2 to 1:2.7 and about 5 to 15% of water, the zeolite is a type A zeolite of particle size in the range of about 3 to 12 microns and a moisture content of about 10 to 25% and the nonionic detergent is a condensation product of a higher fatty alcohol of 10 to 18 carbon atoms and 6 to 12 mols of ethylene oxide per mol.

4. A heavy duty detergent according to claim 3 wherein the sodium tripolyphosphate particles are spray-dried particles of substantially globular form and include from about 70 to 85% of sodium tripolyphosphate, 10 to 20% of sodium silicate of $Na_2O:SiO_2$ ratio of about 1:2.4, 5 to 15% of water and 0.1 to 5% of fluorescent brightener, the zeolite is a crystalline type 4A zeolite of moisture content of about 17 to 22% and the nonionic detergent is a condensation product of a higher fatty alcohol of about 12 to 15 carbon atoms and about 7 mols of ethylene oxide per mol of higher fatty alcohol, the proportions of sodium tripolyphosphate particles, zeolite and nonionic detergent are 35 to 45%, 35 to 45% and 10 to 30%, respectively, the product contains no more than 8.7% of phosphorus and the particles are substantially all of 6 to 100 mesh.

5. The detergent according to claim 1 wherein said zeolite particle size is from about 100–400 mesh, U.S. Standard Sieve Series.

6. The detergent according to claim 1 wherein about 5–20% of the total nonionic detergent remains as a coating on the surface of the particles.

7. A method of making a free-flowing particulate heavy duty laundry detergent of bulk density of at least about 0.8 g/cc. and comprising about 30–50% of substantially globular, spray-dried sodium tripolyphosphate particles, ion-exchanging zeolite and nonionic detergent which comprises overcoating said sodium tripolyphosphate particles of sizes in the 8 to 160 mesh range, U.S. Standard Sieve Series, with about 5–30% of a nonionic detergent in liquid form so that the detergent penetrates the sodium tripolyphosphate particles and a part of said detergent coats the surfaces of said particles, and then mixing said coated particles with about 30–50% of zeolite particles of ultimate particle diameters in the range of 0.01 to 20 microns whereby the zeolite adheres to the surface of said coated particles, rendering them free-flowing.

8. The method according to claim 7 wherein the sodium tripolyphosphate particles exclusive of nonionic detergent therein contain at least 60% of sodium tripolyphosphate, the zeolite is selected from the group consisting of crystalline, amorphous and mixed crystalline-amorphous zeolites of types A, X and Y and the nonionic detergent is a higher fatty alcohol polyethylene oxide condensate wherein the higher fatty alcohol is of 10 to 18 carbon atoms and the polyethylene oxide is of 3 to 15 mols of ethylene oxide per mol of higher fatty alcohol, the nonionic detergent is normally liquid or pasty and is sprayed at a temperature of at least 40° C. onto moving surfaces of the tripolyphosphate particles.

9. The method of claim 7 wherein about 5–20% of the total nonionic detergent remains as a coating on the surface of the particles.

10. A method according to claim 8 wherein the zeolite is a type A zeolite, and the polyethylene oxide is about 6 to 12 moles of ethylene oxide per mole of higher fatty alcohol.

* * * * *